US010258107B2

(12) United States Patent
Surace et al.

(10) Patent No.: US 10,258,107 B2
(45) Date of Patent: Apr. 16, 2019

(54) SHOE WITH A HEEL CAP AND/OR ANKLE COLLAR

(71) Applicant: adidas AG, Herzogenaurach (DE)

(72) Inventors: Anja Surace, Herzogenaurach (DE); Christian Zwinger, Herzogenaurach (DE); Andreas Alonso Egerer, Herzogenaurach (DE); Marco Kormann, Herzogenaurach (DE); Jürgen Hertlein, Herzogenaurach (DE); Georg Trost, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 14/795,368

(22) Filed: Jul. 9, 2015

(65) Prior Publication Data

US 2016/0007687 A1 Jan. 14, 2016

(30) Foreign Application Priority Data

Jul. 9, 2014 (DE) ..... 10 2014 213 366

(51) Int. Cl.
*A43B 5/00* (2006.01)
*A43B 7/06* (2006.01)
(Continued)

(52) U.S. Cl.
CPC ..... *A43B 23/088* (2013.01); *A43B 5/00* (2013.01); *A43B 7/06* (2013.01); *A43B 7/085* (2013.01);
(Continued)

(58) Field of Classification Search
CPC ... A43B 23/088; A43B 23/0205; A43B 23/17; A43B 23/16; A43B 7/141; A43B 7/20;
(Continued)

(56) References Cited

U.S. PATENT DOCUMENTS 1,835,967 A * 12/1931 Reed ..... A43B 23/025 12/146 C
2,535,560 A * 12/1950 Barr ..... A43B 3/30 36/12

(Continued)

FOREIGN PATENT DOCUMENTS

AT 6841 5/2004
CN 101621939 1/2010

(Continued)

OTHER PUBLICATIONS

Chinese Application No. 201510399267.7, Office Action dated Sep. 1, 2016, 9 pages (No English translation available. A summary of the Office Action is provided in the Transmittal Letter submitted herewith).

(Continued)

*Primary Examiner* — Jameson D Collier
*Assistant Examiner* — Heather N Mangine
(74) *Attorney, Agent, or Firm* — Kilpatrick Townsend & Stockton LLP

(57) ABSTRACT

Shoes, in particular sports shoes, and methods for their manufacture can correspond to a shoe that has an upper with a textile region in at least one of a forefoot region and a midfoot region, as well as a heel cap of the upper. The heel cap substantially surrounds a rear side, a medial side, and a lateral side of a heel of a wearer's foot when worn. The heel cap forms a heel region of the upper, and the heel cap is manufactured substantially as one piece from a non-textile flexible plastic material.

21 Claims, 7 Drawing Sheets

(51) Int. Cl.

| | |
|---|---|
| ***A43B 7/08*** | (2006.01) |
| ***A43B 7/14*** | (2006.01) |
| ***A43B 7/20*** | (2006.01) |
| ***A43B 23/02*** | (2006.01) |
| ***A43B 23/08*** | (2006.01) |
| ***A43B 23/17*** | (2006.01) |

(52) U.S. Cl.
CPC ..... *A43B 7/087* (2013.01); *A43B 7/088* (2013.01); *A43B 7/14* (2013.01); *A43B 7/20* (2013.01); *A43B 23/0205* (2013.01); *A43B 23/0295* (2013.01); *A43B 23/17* (2013.01)

(58) Field of Classification Search
CPC ..... A43B 7/085; A43B 23/00; A43B 23/02; A43B 23/0215; A43B 23/0275; A43B 23/027; A43B 23/028; A43B 23/0295
USPC .... 36/92, 72 B, 87, 89, 45, 68, 69, 105, 114
See application file for complete search history.

(56) References Cited

U.S. PATENT DOCUMENTS 3,562,931 A * 2/1971 Karygiannis ..... A43B 23/025 36/45
3,851,411 A * 12/1974 Crosbie ..... A43B 1/10 36/68
4,876,806 A * 10/1989 Robinson ..... A43B 5/00 36/114
5,243,772 A * 9/1993 Francis ..... A43B 5/00 36/106
5,497,564 A * 3/1996 Allen ..... A43C 5/00 24/713.7
5,946,827 A * 9/1999 Okajima ..... A43B 5/0401 36/117.6
6,000,148 A * 12/1999 Cretinon ..... A43B 5/00 36/69
6,128,835 A * 10/2000 Ritter ..... A43C 1/00 36/114
6,237,251 B1 * 5/2001 Litchfield ..... A43B 1/0072 36/114
6,260,290 B1 * 7/2001 Chenevert ..... A43B 5/1666 12/146 C
6,298,582 B1 * 10/2001 Friton ..... A43B 5/06 36/102
6,460,274 B1 * 10/2002 Mateu ..... A43B 5/0401 36/115
6,550,159 B1 * 4/2003 Madore ..... A43B 5/1691 280/11.18
6,877,257 B2 * 4/2005 Delgorgue ..... A43B 5/0411 36/117.1
7,010,867 B2 * 3/2006 Brown ..... A43B 7/12 36/12
7,013,586 B1 * 3/2006 Hatfield ..... A43B 7/20 36/11.5
7,168,188 B2 * 1/2007 Auger ..... A43B 3/0047 36/69
7,204,043 B2 * 4/2007 Kilgore ..... A43B 9/00 36/105
D625,097 S * 10/2010 Portzline ..... D2/946
8,215,036 B2 7/2012 Auger et al.
8,438,757 B2 * 5/2013 Roser ..... A43C 1/00 36/89
8,850,722 B2 * 10/2014 Baker ..... A43B 3/0031 36/105
9,232,831 B2 * 1/2016 Kimura ..... A43B 7/20
9,730,490 B2 * 8/2017 Farris ..... A43B 23/026
2001/0042323 A1 * 11/2001 Fusco ..... A43B 3/0094 36/114
2002/0095823 A1 * 7/2002 Laio ..... A43B 3/24 36/138
2003/0097770 A1 * 5/2003 Karasawa ..... A43B 3/06 36/97
2005/0138846 A1 * 6/2005 O'Connor ..... A43B 5/007 36/72 B
2006/0117608 A1 * 6/2006 Chen ..... A43B 7/10 36/58.6
2008/0134543 A1 * 6/2008 Klein ..... A43B 3/24 36/92
2008/0289222 A1 * 11/2008 Candrian ..... A43B 1/0027 36/101
2009/0071039 A1 * 3/2009 Sussmann ..... A43B 3/0047 36/105
2010/0319218 A1 * 12/2010 Auger ..... A43B 3/242 36/92
2011/0099848 A1 * 5/2011 Tomat ..... A43B 5/02 36/128
2011/0113650 A1 * 5/2011 Hurd ..... A43B 23/08 36/107
2011/0271556 A1 * 11/2011 Dillenbeck ..... A43B 3/242 36/100
2011/0277349 A1 * 11/2011 Kim ..... A43B 3/0005 36/84
2012/0167417 A1 * 7/2012 McDowell ..... A43B 7/085 36/107
2012/0186107 A1 * 7/2012 Crary ..... A43B 3/0078 36/103
2012/0216422 A1 * 8/2012 Ikezawa ..... A43B 7/16 36/83
2012/0317841 A1 * 12/2012 Taylor ..... A43B 3/0084 36/103
2013/0025157 A1 * 1/2013 Wan ..... A43B 7/06 36/45
2013/0219752 A1 * 8/2013 Dombrow ..... A43B 23/0295 36/102
2013/0247418 A1 * 9/2013 Nurse ..... A43B 3/0031 36/92
2013/0340289 A1 * 12/2013 Thevenoud ..... A43B 7/085 36/103
2014/0033573 A1 * 2/2014 Wills ..... A43B 3/246 36/103
2014/0173934 A1 * 6/2014 Bell ..... A43B 1/04 36/84
2014/0196311 A1 * 7/2014 Follet ..... A43B 23/024 36/45
2014/0317962 A1 * 10/2014 Smith ..... A43B 23/0205 36/102
2014/0360049 A1 * 12/2014 Panian ..... A43C 1/006 36/83
2015/0047227 A1 * 2/2015 Fallon ..... A43B 23/026 36/88
2015/0143720 A1 * 5/2015 Avar ..... A43B 23/08 36/107
2016/0095383 A1 * 4/2016 Surace ..... A43B 21/24 36/93
2016/0302515 A1 * 10/2016 Xanthos ..... A43C 11/1493
2017/0105483 A1 * 4/2017 Dojan ..... A43B 23/0235
2017/0340063 A1 * 11/2017 Farris ..... A43B 23/026
2018/0064210 A1 * 3/2018 Turner ..... A43B 1/0072

FOREIGN PATENT DOCUMENTS

| | | |
|---|---|---|
| CN | 103763961 | 4/2014 |
| DE | 29607422 | 9/1996 |
| DE | 202006003491 | 8/2007 |
| DE | 102012206094 | 10/2013 |
| EP | 0090580 | 10/1983 |
| EP | 2502512 | 9/2012 |
| EP | 2649896 | 10/2013 |

OTHER PUBLICATIONS

German Patent Application No. 102014213366.1, Office Action dated May 11, 2015, 7 pages (no English translation available. A summary of the Office Action is provided in the Transmittal Letter submitted herewith).
Nike Aqua Sock IX, Globetrotter Handbook, S. 181, No. 8, 2006, 1 page (no English translation available).

(56) References Cited

OTHER PUBLICATIONS

European Application No. 15175831.5, Extended European Search Report dated Dec. 23, 2015, 7 pages.
European Application No. 15175831.5, Office Action dated Mar. 21, 2017, 5 pages.
German Application No. 102014213366.1, Office Action dated Dec. 7, 2017, 8 pages (3 pages of English translation and 5 pages of original document).

* cited by examiner

SHOE WITH A HEEL CAP AND/OR ANKLE COLLAR

CROSS REFERENCE TO RELATED APPLICATION

This application is related to and claims priority benefits from German Patent Application No. DE 10 2014 213 366.1, filed on Jul. 9, 2015, entitled Shoe with a heel cap as well as shoe with an ankle collar ("the '366 application"). The '366 application is hereby incorporated herein in its entirety by this reference.

FIELD OF THE INVENTION

The present invention relates to a heel cap and an ankle collar as well as shoes, in particular sports shoes, with such a heel cap or with such an ankle collar.

BACKGROUND

Shoes, in particular sports shoes, usually comprise a shoe sole and an upper.

The sole serves the protection of the foot from injuries, which might, for example, be caused by treading on pointed or sharp objects. The sole may further reduce the impact forces acting on the musculoskeletal system of the wearer during impact and hence contribute to the prevention of injuries. An abrasion resistant shoe sole may further increase the life span of a shoe.

In contrast, the upper serves, on the one hand, to secure the foot on the sole of the shoe, such that the sole can perform its above-mentioned tasks. On the other hand, an upper can also provide the foot with additional stability, for example, with respect to twisting ones ankle when treading on uneven terrain, and it may further protect the foot from external influences like water, dirt, heat, UV radiation, and so forth. The upper may be provided such that wearing the shoe is pleasant and comfortable for the wearer, also and in particular when wearing the shoe for longer periods of time. In addition, it is desirable to avoid pressure points and to provide good ventilation, in particular for the case of sports shoes.

To achieve this end, different uppers are known from the prior art. For example, US 2014/0033573 A1 describes a shoe with an inner and outer shell, which may, for example, be manufactured in an injection molding process from ethylene-vinyl-acetate ("EVA"). Further, U.S. Pat. No. 8,215,036 B2 describes a shoe with a sole arrangement and an upper attached thereto. On the upper, a heel cap is located with a heel insert, which is releasably connected to the heel cap.

However, the shoes known from the prior art may, for example, potentially involve a very high manufacturing effort and may comprise a multitude of separate individual parts, they may be rather heavy, and they may only provide for an insufficient ventilation of the foot.

It is therefore an objective underlying the present invention to provide shoes and, in particular, sports shoes, that are light-weight, sufficiently ventilated and easily manufactured while at the same time providing a high degree of stability to the foot of a wearer. At the same time, such shoes may avoid pressure points and provide a good fit and so forth when worn.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a shoe comprises an upper comprising a textile region in at least one of a forefoot region and a midfoot region; a heel cap of the upper, wherein the heel cap substantially surrounds a rear side, a medial side, and a lateral side of a heel of a wearer's foot when worn; wherein the heel cap forms a heel region of the upper; and wherein the heel cap is manufactured substantially as one piece from a non-textile flexible plastic material.

In some embodiments, the heel cap is formed of ethylene-vinyl-acetate ("EVA").

The heel cap may extend down to a sole of the shoe without forming a part of the sole. In certain embodiments, the one-piece heel cap further comprises a medial side wing and a lateral side wing, wherein each wing extends up to a fastening region of the shoe.

In further embodiments, the medial side wing and the lateral side wing each comprise a reinforcing element that is configured to receive a shoe lace. The reinforcing element may comprise a greater stiffness than the flexible plastic material of the heel cap and comprises a socket for an eyelet.

In some embodiments, the medial side wing and the lateral side wing are provided such that they substantially enclose a top surface of a foot of a wearer when worn.

In some embodiments, the heel cap comprises a medial side and a lateral side, wherein a top edge of the medial side and a top edge of the lateral side are positioned below an ankle of a wearer when worn, wherein the top edge of the medial side of the heel cap comprises a different design than the top edge of the lateral side of the heel cap in order to adapt to a different shape of a medial side and a lateral side of the wearer's ankle.

According to certain embodiments of the present invention, a shoe comprises an upper comprising a textile region in at least one of a forefoot region and a midfoot region; a one-piece ankle collar of the upper made from a non-textile flexible plastic material, wherein the one-piece ankle collar comprises a medial side and a lateral side. In these embodiments, a top edge of the medial side and a top edge of the lateral side are positioned below an ankle of a wearer when worn, wherein the top edge of the medial side of the one-piece ankle collar comprises a different design than the top edge of the lateral side of the one-piece ankle collar in order to adapt to a different shape of a medial side and a lateral side of the wearer's ankle In some embodiments, the one-piece ankle collar is formed of ethylene-vinyl-acetate ("EVA"). In further embodiments, the one-piece ankle collar is formed of polyurethane ("PU"), and wherein the shoe further comprises a textile material that is arranged on an inside of the one-piece ankle collar.

In certain embodiments, the top edge of the medial side of the one-piece ankle collar comprises a medial ankle depression, and the top edge of the lateral side of the one-piece ankle collar comprises a lateral ankle depression, and wherein low points of the medial ankle depression and the lateral ankle depression are located according to at least one of (1) different positions along a longitudinal axis of the shoe and (2) a different distance from a support surface for the foot.

In some embodiments, the ankle collar comprises a medial reinforcing element and a lateral reinforcing element, wherein each reinforcing element is configured to receive a shoe lace.

According to certain embodiments, the medial reinforcing element and the lateral reinforcing element each comprise a greater stiffness than the flexible plastic material of the one-piece ankle collar and further each comprise a socket for an eyelet.

In some embodiments, the one-piece ankle collar substantially encloses a top surface of a foot of a wearer when worn.

In certain embodiments, the one-piece ankle collar substantially surrounds a rear side, a medial side, and a lateral side of a heel of a wearer's foot when worn, and wherein one-piece the ankle collar forms a heel region of the upper.

In some embodiments, the one-piece ankle collar comprises a widened support region in at least one of the top edge of the medial side and the top edge of the lateral side. The widened support region may comprise an outwardly curved region of the flexible plastic material of the one-piece ankle collar.

In certain embodiments, the upper consists essentially of one or more textile materials in at least one of the forefoot and the midfoot region.

BRIEF DESCRIPTION OF THE DRAWINGS

In the following detailed description, embodiments of the invention are described referring to the following figures.

BRIEF DESCRIPTION

Figure 1A:
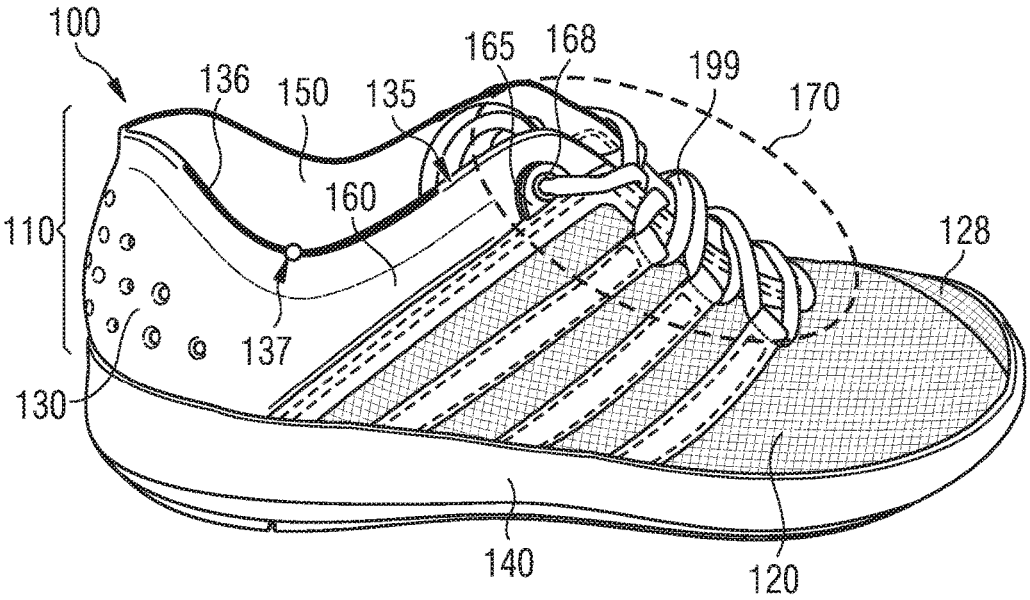
FIGS. 1*a-h* are various views of a shoe, according to certain embodiments of the present invention.

According to certain aspects of the invention, a shoe, in particular a sports shoe, with an upper comprises a textile region in the forefoot and/or midfoot region. The shoe further comprises a heel cap of the upper which encompasses the heel of the foot from behind as well as on the medial and lateral side, wherein solely the heel cap forms a heel region of the upper and wherein the heel cap is further manufactured essentially as one piece from a non-textile flexible plastic material.

First, the textile region in the forefoot and/or midfoot region of the upper permits a good ventilation of the shoe and hence facilitates a pleasant wearing sensation. To this end, the textile region may, for example, comprise a textile fabric having a net-like or honeycomb-like structure, or ventilation openings with a different design may be provided. A textile region in the forefoot and/or midfoot region can furthermore reduce the weight of the upper, for example, compared to an upper that is completely manufactured from a non-textile plastic material.

It is in principle conceivable that in addition to the textile region the upper comprises also a non-textile region in the forefoot and/or midfoot region. That is, the forefoot region and/or midfoot region of the upper can also comprise non-textile materials in addition to one or more textile materials.

It is, however, also possible that in the forefoot region and/or midfoot region, the upper essentially or completely consists of one or more textile materials, for example of one or more textile plastic materials. This permits providing a particularly lightweight and well ventilated shoe.

In this context, "essentially" means that the part of the upper that provides stability and secures the foot is manufactured from the textile material in the forefoot region and/or the midfoot region. In principle, the upper can comprise further ornamental elements in the forefoot region and/or in the midfoot region like, for example, color- or varnish layers, stickers or embossing, or a (thin) foil as is, for example, the case at the tip of the foot of the shoe 100 shown in FIGS. 1*a-h* (see below).

The statement that the upper consists essentially of one or more textile materials in the forefoot region and/or the midfoot region may in particular mean that in the forefoot region and/or the midfoot region the upper does not comprise a non-textile material and, in particular, no (foamed) EVA or (foamed) PU or different foamed plastic materials.

In order to achieve the desired securing and stabilization of the foot, the inventive shoe further comprises a heel cap, which solely forms the heel region of the upper. The heel cap encloses the heel of the foot of the wearer from behind and on both sides, such that the heel cannot slide to the side or in the backward direction. The heel cap can further prevent the heel from sliding upwards (heel slip), i.e. the heel cap can also contribute to securing the heel on the sole. In order to promote this effect, the heel cap may be adapted to the anatomy of the heel of the wearer. Since the heel cap solely forms the heel region of the upper, meaning that no further parts of the upper are present there, a particularly good securing and stabilization of the heel of the foot is achieved. As a result, this leads to a stable wearing sensation while at the same time the textile region in the forefoot and/or midfoot region may be provided very light-weight and thin.

In order to further promote this securing, the heel cap is further manufactured essentially as one piece from the non-textile flexible plastic material, wherein this material is on the one hand flexible enough to allow a simple donning of the shoe, wherein the heel cap may adapt to the anatomy of the foot of the wearer. On the other hand, the non-textile flexible plastic material should comprise a sufficient strength and resilience in order to permit the desired stabilization and securing of the foot.

In this context, "essentially" means that the part of the heel cap that provides the stability and secures the foot is manufactured as a single piece from the non-textile flexible plastic material. In principle, the heel cap can comprise further ornamental elements like, for example, color- or varnish layers or something similar, or a (thin) textile layer on its inside, such that the wearer does not feel the plastic material directly on his skin, such that the wearing sensation is improved. In certain embodiments, however, the heel cap consists completely and solely of the non-textile flexible plastic material, such that the heel cap can contribute to the stabilization and securing of the foot particularly efficiently, as it forms a single integral component.

The stabilization and securing of the foot can further be facilitated by the fact that the shape of the heel cap is modeled to the anatomy of the foot of the wearer, as already suggested above. Also in this context, it may be desirable if the heel cap is manufactured as a single piece from the non-textile flexible plastic material, since by the one-piece design and the dispensation with additional elements, transition points or connection regions like seems, which might impair the fit of the heel cap, can be avoided. The good fit of the heel cap also allows the heel cap to be provided with rather thin walls and is therefore light-weight compared to a stabilizing element that is not adapted to the anatomy of the heel, wherein the desired stabilization effect can still be achieved due to the good fit of the heel cap.

In order to also allow series production of shoes with such an anatomically adapted heel cap, for example, a 3D-mold may be used for the manufacture with a shape that is based on the empirically determined anatomy of an average foot of a certain foot size or class of sizes.

It is in particular conceivable that the heel cap consists of ethylene-vinyl-acetate (EVA).

On the one hand, EVA may be easily processed. Moreover, EVA comprises certain desirable flexibility properties for securing and stabilizing the foot by means of a heel cap consisting of this material. It is in particular resilient and tear proof and still stretchable enough that the shoe may be easily donned and that it does not feel too stiff during wearing. EVA is further pleasant on the skin as it does not have the tendency to stick to the skin, for example, in combination with moisture like sweat or rain.

The inside of the heel cap can, for example, comprise a groove- or lattice-structure which can further impede such sticking It is possible that the heel cap extends down to a sole of the shoe without forming a part of the sole.

In this manner, as large an area of the heel as possible is enclosed by the heel cap such that a very good securing and stabilization of the foot within the shoe can be achieved. On the other side, the heel cap does not lead to an impairment of the wearing sensation, in particular during impact, as it does not form a part of the sole and therefore does not—at least not to a noticeable degree—impair, for example, the cushioning- and energy return-properties of the sole.

The one-piece heel cap can further comprise a medial side wing and a lateral side wing which each extend up to a fastening region of the shoe.

The side wings may further stabilize and secure the foot. The side wings can also serve the purpose of providing shape to the textile region in the forefoot and/or midfoot region of the shoe or contribute thereto. The side wings can, for example, contribute to providing shape to the textile region in the forefoot and/or midfoot region in that the textile region is arranged on top of the side wings in a kind of tent-structure.

The medial and the lateral side wing may each comprise a reinforcing element which serves to receive a fastening means, in particular a shoe lace.

By means of the reinforcing elements, the foot may be particularly well secured in the heel cap and hence in the shoe, since the heel cap and the fastening means, for example the lacing of the shoe, from a contiguous element.

In this context, it is in particular conceivable that such a reinforcing element comprises a larger stiffness than the flexible plastic material of the heel cap and that it comprises a socket for an eyelet.

The reinforcing element may hence act as a kind of washer which helps to avoid the eyelet tearing from the flexible plastic material or being directly shot through the flexible plastic material during the manufacture.

The medial side wing and the lateral side wing may also be provided in such a manner that they enclose the foot on its top side.

By enclosing the foot on its top side, for example by enclosing the foot along the instep, the foot may be secured in the shoe particularly well and the enclosing may further lead to a homogeneous pressure distribution and hence serve the purpose of avoiding pressure points, chafing, or blisters.

A further aspect of the present invention is provided by a shoe, in particular a sports shoe, with an upper that comprises a textile region in the forefoot and/or midfoot region. The shoe further comprises a one-piece ankle collar of the upper made from a non-textile flexible plastic material which extends below an ankle and around a heel from a lateral to a medial side of the upper. A medial top edge of the ankle collar comprises a different design than a lateral top edge of the ankle collar in order to adapt to the different shape of the medial and lateral side of the ankle.

The benefits of a textile region in the forefoot and/or midfoot region have already been elaborated on and these advantages also apply here. It is, in particular, conceivable that the upper also comprises a non-textile region in the forefoot and/or midfoot region in additional to the textile region. That is, the forefoot and/or midfoot region of the upper can also comprise non-textile materials in addition to one or more textile materials. It is, however, also possible that the upper consists essentially or even completely of one or more textile materials in the forefoot and/or midfoot region, for example, of one or more textile plastic materials, and this may, for example, serve the purpose of providing a particularly light-weight and well ventilated shoe.

The meaning of the term "essentially" in this context has already been defined at a different place further above.

The ankle collar may contribute to providing the desired shape to the textile region, for example, by way of the collar carrying or spanning the textile region.

The ankle collar also serves the purpose of securing or stabilizing the foot in the upper. The ankle collar encompasses the ankle and the heel of the wearer by extending from below the lateral ankle across the heel to the medial side of the foot and further below the medial ankle.

In this regard, it may be beneficial that the medial top edge of the ankle collar comprises a different design than the lateral top edge of the ankle collar. The reason is that the positions of the medial and lateral ankle on the foot of a wearer are often not symmetric with respect to the longitudinal axis of the foot/shoe. Rather, the medial and lateral ankle are often asymmetrically located. In addition, the medial and the lateral ankle often comprise different dimensions and extensions. By means of the different design of the medial top edge and the lateral top edge, the ankle collar can be tailored to these anatomical conditions and hence facilitate a particularly good fit and a pleasant wearing sensation. In this manner, in particular, pressure points and chaffing can be avoided.

It is possible that the ankle collar consists of ethylene-vinyl-acetate ("EVA").

EVA is particularly well suited also for an ankle collar due to the beneficial properties already mentioned above, which also apply here.

It is further possible that the ankle collar consists of polyurethane ("PU") and that the shoe further comprises a textile material which is arranged on an inside of the ankle collar.

PU is a further material that is well suited for the manufacture of an inventive ankle collar due to its elasticity and stability properties. PU can, however, have the tendency to evoke an unpleasant wearing sensation when directly contacting the skin, for example, due to its tendency to stick to the skin. For the case of an ankle collar made from PU, the ankle collar therefore may be covered with a textile material which is pleasant to the skin on the side facing the leg/foot.

It is, in particular, conceivable that the medial top edge of the ankle collar comprises a medial ankle depression and the lateral top edge of the ankle collar comprises a lateral ankle depression, wherein low points of the medial and the lateral ankle depression are located at different positions along a longitudinal axis of the shoe and/or are located a different distance from a support surface for the foot.

The medial and lateral ankle collar "accommodate" the medial and lateral ankle during wearing of the shoe and support the ankle, which can lead to a stabilization of the foot, for example, with respect to twisting ones ankle, and at the same time promote a pleasant wearing sensation. In order to further improve the stabilization and the comfort, the respective position and design of the medial and lateral ankle depression may be adapted to the different positions and dimensions of the medial and lateral ankle already mentioned.

For example, the low point of the lateral ankle depression can be arranged closer to the heel or farther away from the heel than the low point of the medial ankle depression. The low point of the lateral ankle depression can also be arranged closer to a support surface for the foot (lower), in particular closer to the shoe sole, or farther away from it (higher) than the low point of the medial ankle depression.

The low point of the lateral ankle depression can, for example, be arranged 2 mm-20 mm or 3 mm-15 mm or 4 mm-13 mm closer to the heel or farther away from it than the low point of the medial ankle depression and/or the low point of the lateral ankle depression can, for example, be arranged 2 mm-20 mm or 3 mm-14 mm or 4 mm-11 mm closer to the shoe sole or farther away from it than the low point of the medial ankle depression. The low point of the lateral ankle depression can, in particular, be arranged closer to the heel and closer to the shoe sole than the low point of the medial ankle depression, for each case by a value from the above-mentioned ranges, for example.

The skilled person realizes that the respective positions and designs of the medial and lateral ankle depression may be directly adapted to the anatomical conditions of the foot of a future wearer. Insofar, the above-mentioned values are only examples of individual "standard ranges/values" as they are often encountered and recourse to which may therefore be made in case a measurement of the foot of the future wearer is not possible or not desired, or if the manufacture does not allow such a "custom fit" but can only offer some fixed, predetermined choices.

The ankle collar can also comprise a medial and lateral reinforcing element which each serve to receive a fastening means, in particular shoe lace.

The medial and the lateral reinforcing element can each comprise a larger stiffness than the flexible plastic material of the ankle collar and the medial and lateral reinforcing element can further each comprise a socket for an eyelet.

The benefits of such reinforcing elements have already been pointed out above and the explanations made there also apply here analogously.

It is in particular possible that the ankle collar encloses the foot of a wearer on its top side.

As already mentioned, by enclosing the foot, the foot may be secured within the shoe particularly well and the enclosing can furthermore lead to a homogeneous pressure distribution and hence serve the purpose of avoiding pressure points, chaffing, or blisters.

At this point, it is furthermore explicitly pointed out that it is both possible that an inventive heel cap also assumes the function of an inventive ankle collar. Likewise, an inventive ankle collar assumes the function of an inventive heel cap. Insofar, the statements made above with regard to the design possibilities and properties of the heel cap and the ankle collar may also be combined with one another.

An inventive heel cap can, in particular, extend below the ankle and around the heel from the lateral to the medial side of the upper, wherein the medial top edge of the heel cap comprises a different design than the lateral top edge of the heel cap in order to adapt to the different shape of the medial and lateral side of the ankle.

The other way around, an inventive ankle collar can also encompass the heel of the foot from behind as well as on the medial and lateral side, wherein solely the ankle collar forms the heel region of the upper.

It is further conceivable that the heel cap or the ankle collar comprises a widened support region at a top edge.

Such a widened support region helps to avoid chaffing, cuts, or other injuries of the foot and therefore further contributes to an improved wearing comfort.

The widened support region can, in particular, comprise an outwardly curved region of the flexible plastic material of the heel cap or the ankle collar.

Such an outwardly curved region can be created directly during the manufacture of the heel cap or the ankle collar, for example, by means of a corresponding design of the mold used for the manufacture, without any further processing steps being necessary.

Finally, reference is made to the possibility that textures are imprinted onto the inside and/or outside of selected non-textile components of an inventive shoe or worked into such components, for example, on the inside and/or outside of the heel cap or the ankle collar or different components made from, for example, (foamed) EVA or (foamed) PU.

Such textures may, for example, comprise sundry structural elements, patterns, groove-or lattice-structures or combinations thereof. Moreover, such textures can be provided in a manner that they permit a microcirculation of air during wearing, which can increase the wearing comfort of the shoe.

Such textures can, for example, be created during the manufacturing process through the use of a correspondingly textured molding tool and/or through further processing steps during and/or after the general shaping.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain embodiments of the invention will be described in the following detailed description with reference to boat shoes and sports shoes. It is emphasized, however, that the present invention is not limited to these embodiments. Rather, the present invention may also be applied in different kind of shoes, in particular in running shoes, shoes for fishing, and so forth.

It is furthermore pointed out that only individual embodiments of the invention can be described in the following. The skilled person will understand, however, that the elements and design options described in the context of these concrete embodiments may also be modified and combined with one another in a different manner within the scope of the invention and that individual elements can also be omitted if they seem dispensable for a concrete shoe. In order to avoid redundancies, reference is therefore in particular made to the explanations in the "Summary of the invention," which also remain applicable for the following description.

FIGS. 1*a-h* show certain embodiments of an inventive shoe 100. The shoe 100 can, for example, be used as a boat shoe but also as a leisure shoe, and so forth.

Figure 1B:
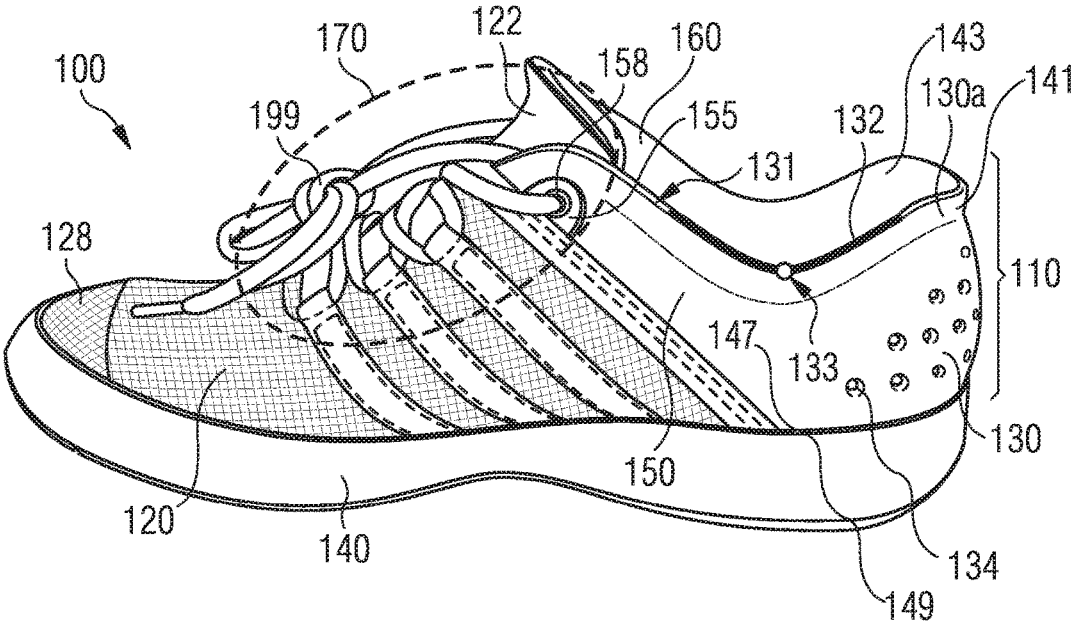
Figure 1C:
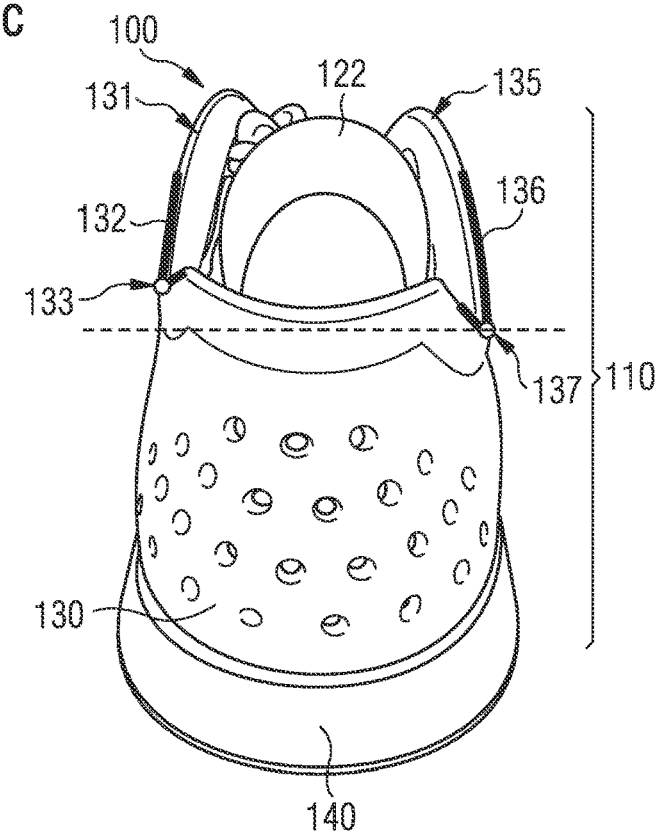

FIG. 1*a* shows the lateral side of the shoe 100 and FIG. 1*b* the medial side. FIG. 1*c* shows a heel view and FIG. 1*d* an enlarged view of the ankle region of the shoe 100 from the lateral side. FIG. 1*e* shows the shoe 100 from the front and FIG. 1*f* the heel region of the shoe 100 together with the interior of the shoe from above. FIG. 1*g* shows the sole of the shoe 100 and FIG. 1*h* shows an enlarged view of the fastening region, in particular of the lacing, of the shoe 100.

The shoe 100 comprises an upper 110 with a textile region 120 in the forefoot and midfoot region. In the case of the present shoe 100, the textile region 120 extends from the tips of the toes up to the side wings 150, 160 of the heel cap 130 (see below). This textile region 120 in the forefoot and midfoot region facilitates a pleasant wearing sensation. To this end, the textile region 120 can, for example, comprise a textile fabric provided in a net-like or honeycomb-like manner, or ventilation openings with a different design may be provided. While the shoe 100 shown here comprises a foil 128 on its upper 110 at the tip of the foot, in the forefoot region and up to the midfoot region the upper 110 essentially consists of textile material. In these regions, the upper 110 does, in particular, not comprise any foamed plastic material like foamed EVA or foamed PU. It is also possible to do without the foil 128. It should further be noted that the upper 110 may also comprise a textile fabric 125 on its bottom side, as will be further described below. The shoe 100 further comprises a sole or sole unit 140. The sole 140 can, for example, comprise a foamed plastic material, for example, foamed EVA and it can, in particular, comprise randomly arranged particles of an expanded material that are fused at their surfaces, in particular particles from expanded thermoplastic polyurethane or expanded polyetherblockamide. Soles comprising such expanded particles and methods for their manufacture are, for example, described in documents DE 10 2012 206 094 A 1 and EP 2 649 896A2.

As can be gathered from FIG. 1*g*, the sole 140 further comprises an outsole 145. The outsole comprises profile elements 146, which may prevent slipping, for example, on board of a boat. In particular for use as a boat shoe, openings 148 are provided in the sole 140 such that water that may have entered the shoe can flow out of the shoe 100 again through these openings 148. This is further facilitated by the fact that the upper 110 comprises a textile fabric 125 on its bottom side within the interior of the shoe, as shown in FIG. 1*f*, such that the outflow of the water is not impeded. Furthermore, the textile fabric 125 and hence the interior of the shoe can dry again rather quickly. In order to at the same time prevent dirt or pointed objects from entering the shoe 100 through the openings 148, the openings 148 each comprise a gauze, for example, made from metal or plastic.

The upper 110 comprises a heel cap 130 of the upper 110. The heel cap 130 encompasses the heel of the foot from behind as well as on the medial and lateral side. In order to allow a good ventilation of the foot, a number of ventilation openings 134 (e.g., FIG. 1*b*) are arranged in the heel cap 130. The number, arrangement, and size of these openings is chosen such that, if at all, they only decrease the stability of the heel cap 130 to a desired and acceptable degree. The heel cap 130 further comprises a lattice structure (not visible) on its inside that impedes the heel cap 130 from sticking to the skin of the wearer and hence contributes to a good wearing comfort, also with bare feet.

In certain embodiments, the heel cap 130 solely forms the heel region of the upper 110, and the heel cap 130 is manufactured as one piece from a non-textile flexible plastic material, in the present case from EVA. For example, the heel cap 130 may be formed of a single piece of non-textile flexible plastic material that has a first surface 141 and a second surface 143 (e.g., with an uppermost edge of the heel cap 130 providing a transition between the first surface 141 and the second surface 143), where the first surface 141 forms a portion of an exterior-most surface of the shoe 100 (e.g., along with the uppermost edge of the heel cap 130), and where the second surface 143 forms a portion of an interior-most surface of the shoe 100 facing an opening of the shoe 100 for receiving a foot of the wearer. The heel cap 130 is further provided in such a manner that it extends down to the sole 140 of the shoe without forming a part of the sole 140. For example, the heel cap 130 can have a lowermost edge 147 that terminates at or above an upper perimeter edge 149 of the sole 140.

By this design of the heel cap 130, the heel of the wearer can be well enclosed by the heel cap 130 and secured therein, without the heel cap 130 impeding the treading or the roll-off of the foot as it does not or only insignificantly alter the properties of the sole 140.

In case of the shoe 100, the one-piece heel cap 130 further comprises a medial side wing 150 and a lateral side wing 160, each of which may extend up to a fastening region 170 of the shoe.

The side wings 150, 160 can further stabilize the foot and secure it. The side wings 150, 160 further serve the purpose of providing shape to the textile region 120 in the forefoot and midfoot region of the shoe 100. The fact that the heel cap 130, the side wings 150, 160, and at least a part of the fastening region 170 are provided as an integral component furthermore facilitates the stability and durability of the shoe 100 and permits a good securing of the foot within the shoe. In collaboration with the heel cap 130, the side wings 150, 160 can, in particular, prevent or limit a slipping of the heel, for example in the shape of a heel slip.

In the present case, the fastening region 170 comprises a tongue 122 and a lacing that may be fastened with a shoe lace 199. In principle, however, different designs of the fastening region 170 are also conceivable, for example, hook and loop fasteners or flexible rubber bands.

The medial 150 and the lateral 160 side wing each comprise a reinforcing element 155, 165, which serve to receive the shoe lace 199, wherein the two reinforcing elements 155, 165 comprise a larger stiffness than the flexible plastic material, i.e. in the present case EVA, of the heel cap 130 and the medial 150 and lateral 160 side wing. The reinforcing elements 155, 165 additionally each comprise an eyelet 158, 168 arranged in a corresponding socket of the reinforcing elements 155, 165. Without the reinforcing elements 155, 165, there would be the danger of the shoe lace 199, potentially together with the eyelets 158, 168, tearing from the material of the side wings 150, 160. Also, without the reinforcing elements 155, 165, the eyelets 158, 168 could be "shot through" the material of the side wings 150, 160 already during the manufacture. The reinforcing elements 155, 165 hence function as a kind of washer in order to permit a stable and reliable connection of the eyelets 158, 168 with the (softer) material of the side wings 150, 160.

It shall finally be mentioned that it is in principle also possible that the medial side wing and the lateral side wing are provided in such a manner that they enclose the foot on its top side, for example, in a common overlap region (not shown).

In the present case, the heel cap 130 along with the medial side wing 150 and the lateral side wing 160 also form a one-piece ankle collar 130*a* of the upper 110 made from a non-textile flexible plastic material (in the present case EVA), which (in the worn state of the shoe 100) extends below an ankle and around the heel from the lateral to the medial side of the upper 110. For ease of explanation, reference below may be made to the ankle collar 130 (i.e., without the corresponding suffix 'a'), for example, to facilitate discussion of features that may correspond to either or both of the heel cap 130 and/or the ankle collar 130*a*. The medial top edge 131 of the heel cap/the ankle collar 130 comprises a different design than the lateral top edge 135 of the heel cap/the ankle collar 130 in order to adapt to the different shape of the medial and lateral side of the ankle. This can, in particular, be clearly seen in FIGS. 1*c*, 1*d* and 1*f*.

For ease of explanation, reference will be made to the ankle collar 130 in the following but it must be kept in mind that the ankle collar also assumes the function of a heel cap 130 and that the considerations made herein in this regard therefore equally apply to the ankle collar 130.

In particular, the medial top edge 131 of the ankle collar comprises a medial ankle depression 132 and the lateral top edge 135 of the ankle collar comprises a lateral ankle depression 136, wherein the low points 133 and 137 of the medial 132 and the lateral 135 ankle depression are located at different positions on a longitudinal axis of the shoe 100, for example, the axis from the middle of the heel region to the middle of the forefoot region, or they are located a different distance from a support surface for the foot, in the present case from the sole 140 of the shoe 100. The skilled person will understand that the decisive quantity is the distance to the support surface of the foot and not the absolute distance to the ground, since only the distance between the sole of the foot and the ankle is anatomically determined. The distance between the ground and the ankle, on the other side, is also influenced by the design of the sole 140, in particular its thickness.

Figure 1D:
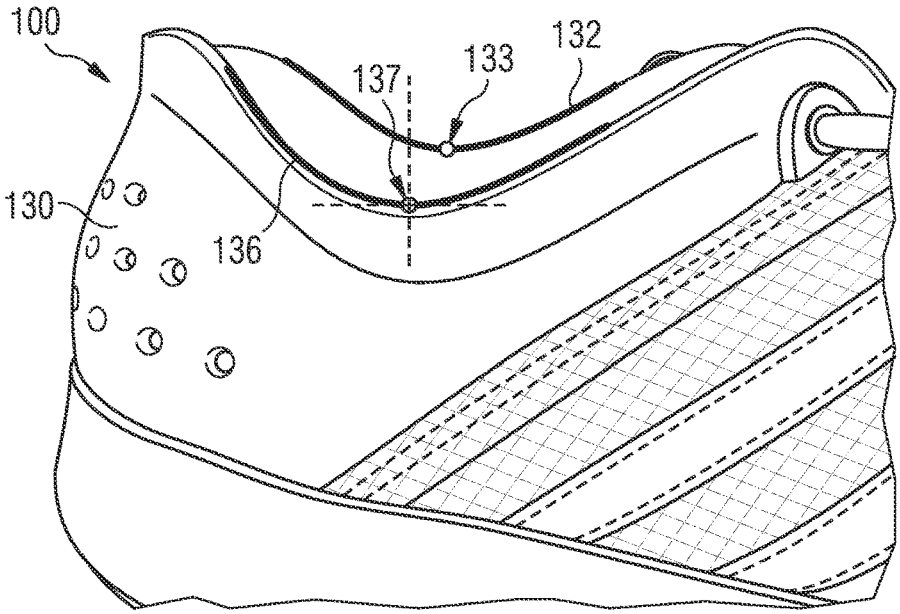
Figure 1E:
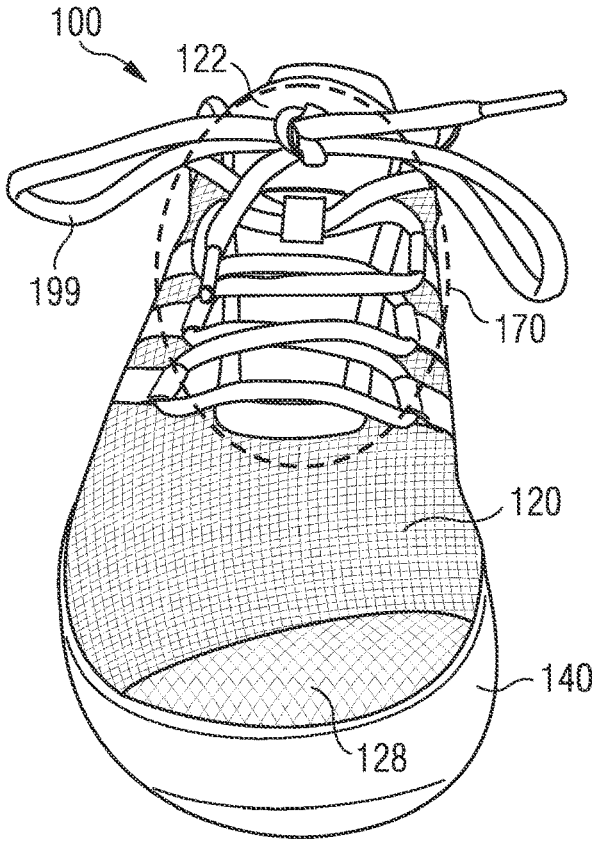
Figure 1F:
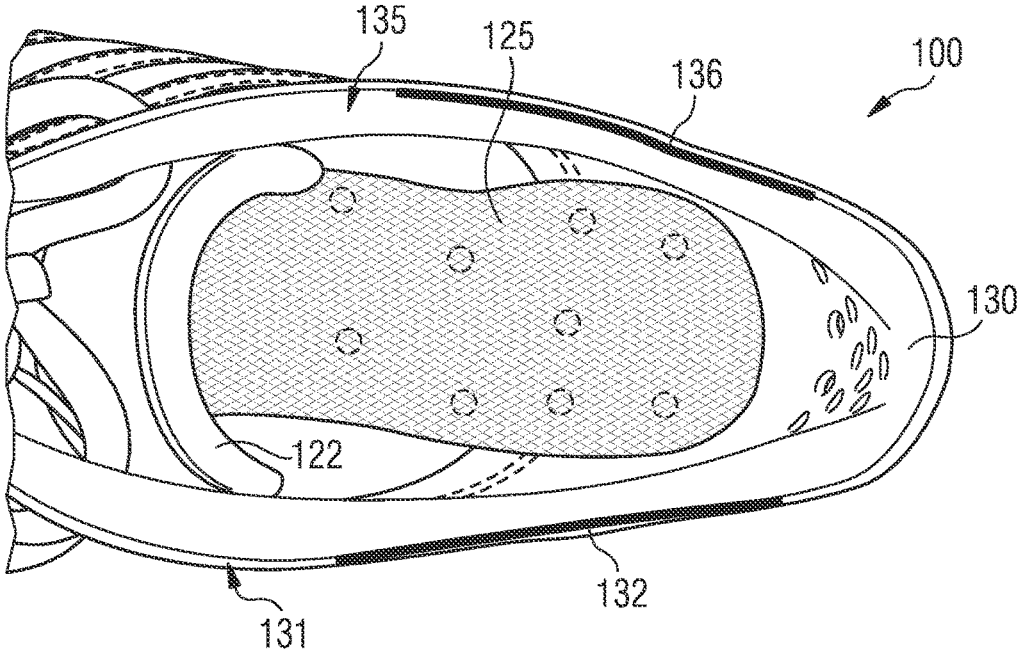
Figure 1G:
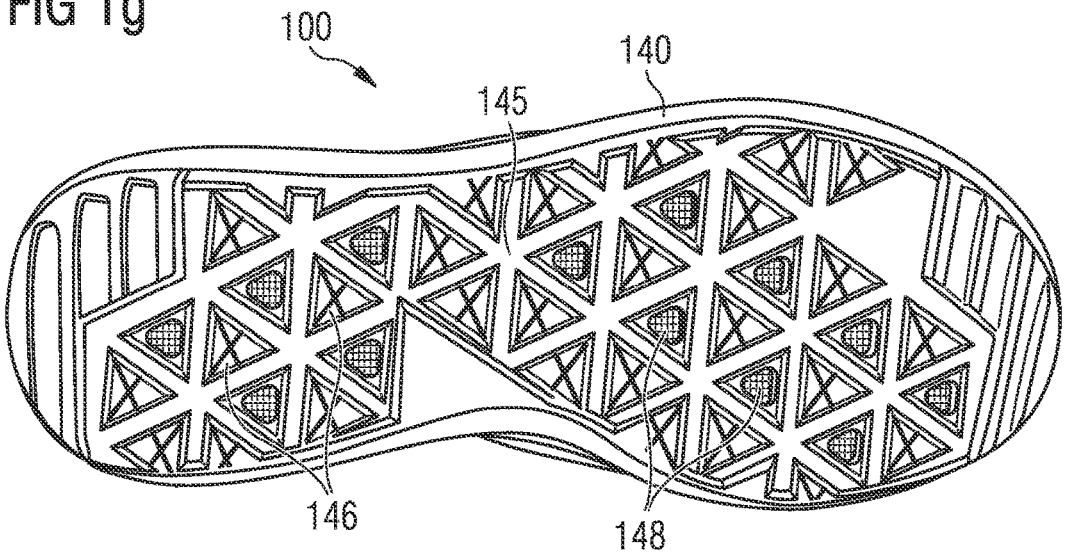
Figure 1H:
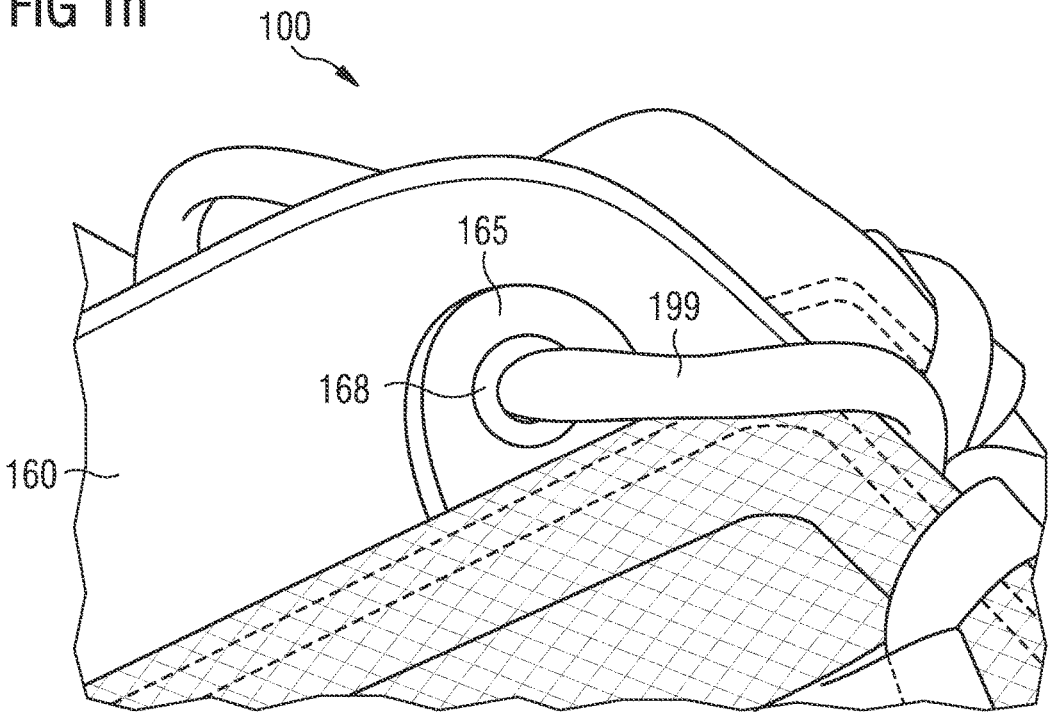

The difference in designs of the ankle depressions 132 and 136 as well as the different positions of the respective low points 133 and 137 are, in particular, clearly visible in FIGS. 1*c* and 1*d*. As a remark, FIGS. 1*c*-*d* were each photographed from such a perspective that the actual designs and the positions can be seen as realistically as possible. However, perspective distortions cannot be completely excluded. It is the main purpose of the shown figures to show the possibilities of the invention and the way the invention works. The actual proportions encountered in a shoe 100 may deviate from the proportions and dimensions shown here within the scope of the invention. In order to provide for a good stabilization of the foot within the upper 110 and the shoe 100, and to further increase the wearing comfort, it is, in particular, possible and beneficial if the respective positions and designs of the medial and lateral ankle depression 132 and 136 are adapted to the anatomy of the foot of a future wearer of the shoe 100.

The low point 137 of the lateral ankle depression 136 can, for example, be arranged closer to the heel than the low point 133 of the medial ankle depression 132, or vice versa. In embodiments of the shoe 100 shown here, the low point 137 of the lateral ankle depression 136 is, for example, arranged approximately 5 mm closer to the heel—measured along the longitudinal axis from the middle of the heel region of the shoe 100 to the middle of the forefoot region—than the low point 133 of the medial ankle depression 132.

The low point 137 of the lateral ankle depression 136 can also, for example, be arranged closer to a support surface for the foot, in particular closer to the shoe sole 140, (lower) than the low point 133 of the medial ankle depression 132, or vice versa. In certain embodiments of the shoe 100 shown here, the low point 137 of the lateral ankle depression 136 is, for example, arranged approximately 5 mm closer to the sole 140 (lower) than the low point 133 of the medial ankle depression 132.

Generally speaking, the low point 137 of the lateral ankle depression 136 can, for example, be arranged 2 mm-20 mm or 3 mm-15 mm or 4 mm-13 mm closer to the heel (or farther away from it) than the low point 133 of the medial ankle depression 132 and/or the low point 137 of the lateral ankle depression 136 can be arranged, for example, 2 mm-20 mm or 3 mm-14 mm or 4 mm-11 mm closer to the shoe sole 140 (or farther away from it) than the low point 133 of the medial ankle depression 132.

The skilled person realizes that the respective positions and designs of the medial 132 and lateral 136 ankle depressions may be directly adapted to the anatomic properties of the foot of a future wearer, as already mentioned above. Insofar, the above mentioned values only represent some examples of individual "standard ranges/-values", recourse to which can be made if a measurement of the foot of a future wearer is not possible or not desirable.

For example, measurements of feet of the same size or class of sizes (e.g. UK size 6.5-8.5) of a plurality of test persons have revealed that the low point 137 of the lateral ankle depression 136 may be arranged, for example, in a range up to approximately 12 mm closer to the heel and in a range up to approximately 12 mm closer to the sole 140 than the low point 133 of the medial ankle depression 132. With different test persons or measurements of feet of another size/class of sizes, however, different values and ranges may result.

Finally, it is pointed out, that the general design of the ankle depressions 132 and 136 can also be different—see, for example, FIGS. 1*c*, 1*d* and 1*f* -—in order to follow the anatomy of the foot and hence ensure as good a fit of the heel cap 130 or the shoe 100, respectively, as possible. In particular, the curvature of the ankle depressions 132 and 136, their length/diameter/depth, and so forth may be chosen differently, in order to be adapted to the anatomical conditions of a wearer. Or the design of the ankle depressions 132 and 136 is oriented towards an empirically determined 3D-model of an "average foot", for example, of a given class of sizes as explained above.

As already explained, the ankle collar 130 further comprises a medial 155 and a lateral 165 reinforcing element which each serve to receive a shoe lace 199, wherein the medial 155 and the lateral 165 reinforcing element each comprise a larger stiffness than the EVA of the ankle collar 130 and further each comprise a socket for an eyelet 158, 168. For more details on these points, reference is made to the explanations further above.

The heel cap or ankle collar 130 further comprises a widened support region at the two top edges 131 and 135, which is provided as an outwardly curved region of the EVA-material of the heel cap respectively ankle collar 130. Such a region prevents sharp edges and therefore minimizes the danger of chafing, cuts, blisters, or pressure points at the foot and, in particular, at the ankle of the wearer of the shoe 100.

Figure 2:
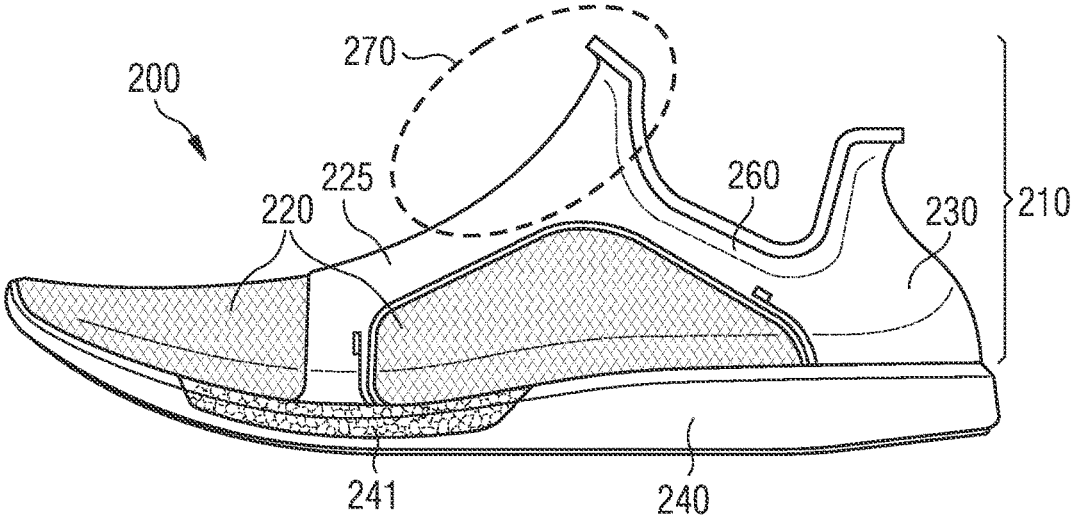
FIG. 2 is a side view of a shoe, according to certain embodiments of the present invention.

FIG. 2 shows additional embodiments of an inventive shoe 200. The shoe 200 also comprises an upper 210 with a textile region 220 in the forefoot and midfoot region. However, the textile region is here intersected by a non-textile region in the form of a support element 225 in the region of the toe joints which is integrally provided as one piece with a heel cap 230. The shoe 200 further comprises a sole 240, which comprises an insert 241 in the forefoot and midfoot region, in particular in the region below the toe joints, and which comprises, for example, randomly arranged particles from expanded thermoplastic polyurethane and/or polyetherblockamide that are fused together at their surfaces.

The heel cap 230 of the upper 210 encompasses the heel of the foot from behind and on the medial and lateral side and solely the heel cap 230 forms the heel region of the upper 210 also in this case. The heel cap 230 is manufactured essentially as one piece from a non-textile flexible plastic material, for example, EVA or PU. As already mentioned, in this context "essentially" means that all components of the heel cap 230 that provide stability and serve the securing of the foot are manufactured as one piece from the non-textile flexible plastic material. In the case of EVA, the one-piece heel cap 230 can, for example, consists solely of EVA. In the case of a heel cap 230 from PU, the heel cap can additionally comprise a thin textile layer on its inside, which prevents a sticking to the skin and hence increases the wearing comfort.

The heel cap 230 extends down to the sole 240 of the shoe 200 without forming a part of the sole 240 also in the case of the shoe 200. Moreover, the one-piece heel cap 230 further comprises a medial side wing (not visible) and a lateral side wing 260, each of which may extend up to a fastening region 270 of the shoe. For the shoe 200, however, the fastening region 270 is provided in that the medial side wing and the lateral side wing 260 enclose the foot on its top side and merge into each other and form a kind of tongue. When donning the shoe, the tongue may be pulled in the forward and upward direction, such that the medial and lateral side wings 260 are stretched in the process and allow an insertion of the foot into the interior of the shoe. After letting go of the tongue, the side wings will contract again and the shoe will be "fastened". In the present case, the fastening region 270 and the tongue integrally merge into the support element 225 in the direction towards the tip of the foot.

Furthermore, in certain embodiments, the heel cap 230 functions as a one-piece ankle collar 230 of the upper 210 that extends below the ankle and around the heel from the lateral to the medial side of the upper 210. To this end, a medial top edge of the ankle collar 230 comprises a different design than a lateral top edge of the ankle collar 230 in order to adapt to the different shape of the medial and lateral side of the ankle Insofar as the heel cap 230 also functions as an ankle collar 230, the considerations made in this regard also apply here—as far as applicable.

Figure 3A:
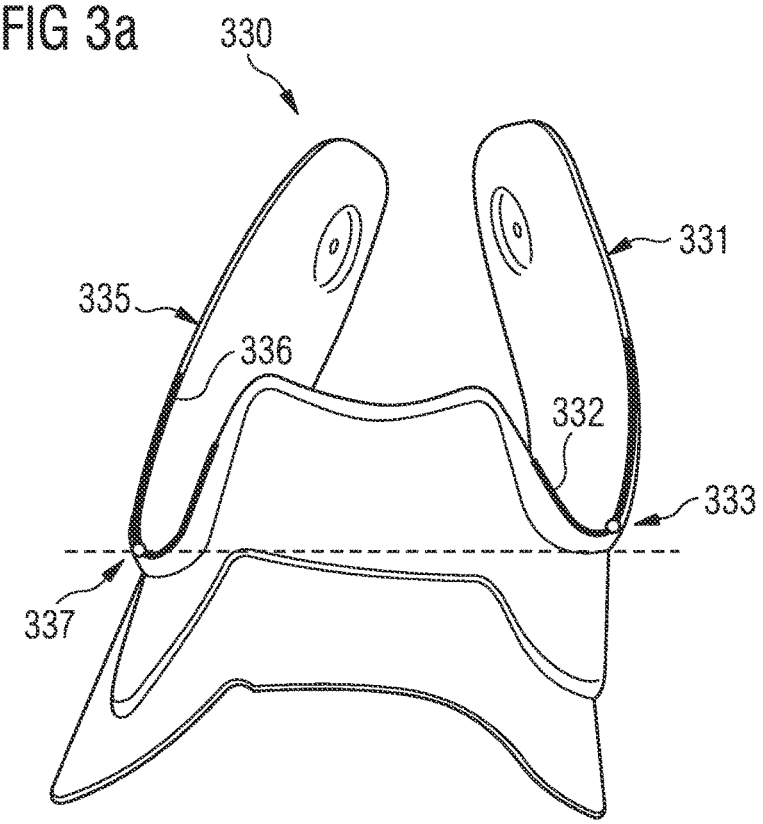
FIGS. 3*a*-3*b* are views of an ankle collar, according to certain embodiments of the present invention.
Figure 3B:
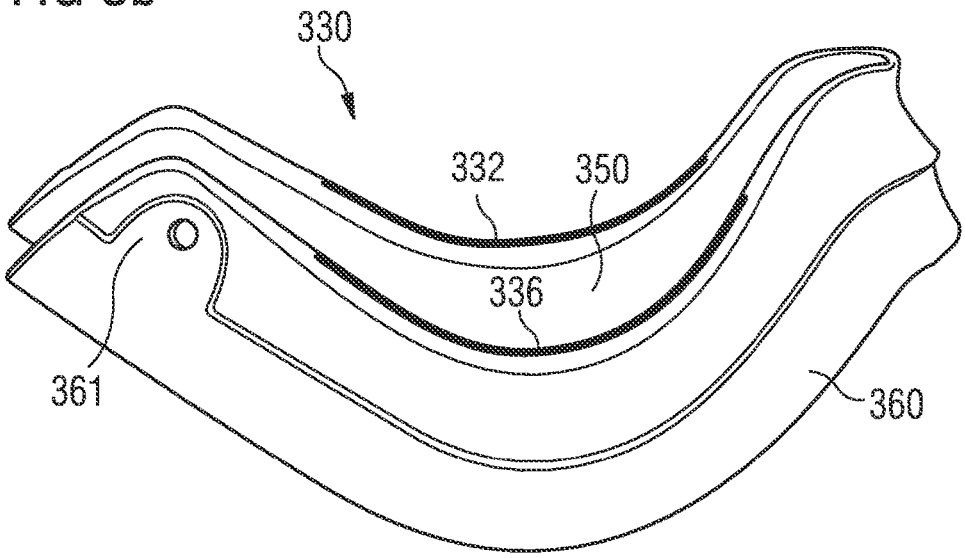

FIGS. 3*a-b* show certain embodiments of an inventive ankle collar 330, without corresponding shoe, and mainly serve to illustrate the different design possibilities with regard to the ankle depressions. It is a one-piece ankle collar 330 made from a non-textile flexible plastic material, in the present case EVA, which when used in a shoe (e.g. as ankle collar 530*a* or 530*b* of the shoe 500*a* or 500*b* of FIGS. 5*a-b*) extends below an ankle and around a heel from a lateral to a medial side of the upper. To this end, the ankle collar 330 comprises a medial side wing 350 and a lateral side wing 360. Shown in FIG. 3*b* is furthermore a slot 361 in the lateral side wing 360. A reinforcing element may later be arranged there which serves to receive a fastening means, in particular a shoe lace, and which comprises a larger stiffness than the flexible plastic material of the ankle collar 330 and the lateral side wing 360 and which may further comprise a socket for an eyelet. Analogous statements also apply to the medial side of the ankle collar.

As can clearly be gathered from FIGS. 3*a-b*, the medial top edge 331 of the ankle collar 330 comprises a different design than the lateral top edge 335 of the ankle collar 330 in order to adapt to the different shape of the medial and lateral side of the ankle.

Also here, the medial top edge 331 of the ankle collar 330 comprises a medial ankle depression 332 and the lateral top edge 335 of the ankle collar 330 comprises a lateral ankle depression 336. The low points 333 and 337 of the medial 332 and the lateral 336 ankle depression are located at different positions, measured relative to the longitudinal axis from the middle of the heel up to the middle of the toe region of the shoe with the ankle collar, and/or the low points 333 and 337 of the medial 332 and the lateral 336 ankle depression are located a different distance from a support surface for the foot.

The low point 337 of the lateral ankle depression 336 can, for example, be arranged 2 mm-20 mm or 3 mm-15 mm of 4 mm-13 mm closer to the heel (or farther away from it) than the low point 333 of the medial ankle depression 332 and/or the low point 337 of the lateral ankle depression 336 can, for example, be arranged 2 mm-20 mm or 3 mm-14 mm of 4 mm-11 mm closer to the support surface of the foot (or farther away from it) than the low point 333 of the medial ankle depression 332.

In certain embodiments of the ankle collar 330 shown here, the low point 337 of the lateral ankle depression 336 is, for example, located approximately 5 mm closer to the support surface of the foot, i.e. lower, than the low point 333 of the medial ankle depression 332.

The different design possibilities for the ankle depressions have already been extensively discussed further above and in order to avoid redundancies reference is insofar made to these explanations which also remain applicable here.

Figure 4:
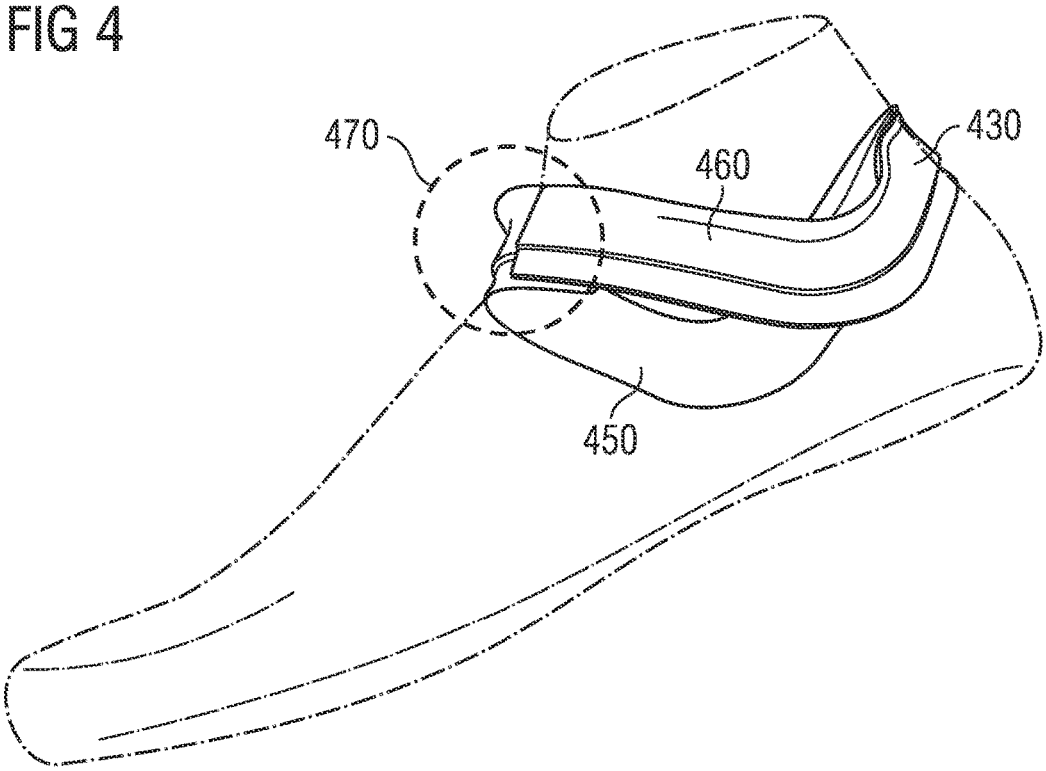
FIG. 4 is a side perspective view of an ankle collar, according to certain embodiments of the present invention.

FIG. 4 once again illustrates the possibility that an ankle collar 430, too, may be provided such that the ankle collar 430 encloses the foot of a wearer on its top side, for example, in the region of the instep 470. For example, a medial side wing 450 of the ankle collar 430 and a lateral side wing 460 of the ankle collar 430 may overlap in the region 470. Or the medial 450 and lateral 460 side wing integrally merge into one another, such that the ankle collar 430 provides a closed ring. Further possibilities are apparent to the skilled person.

Figure 5A:
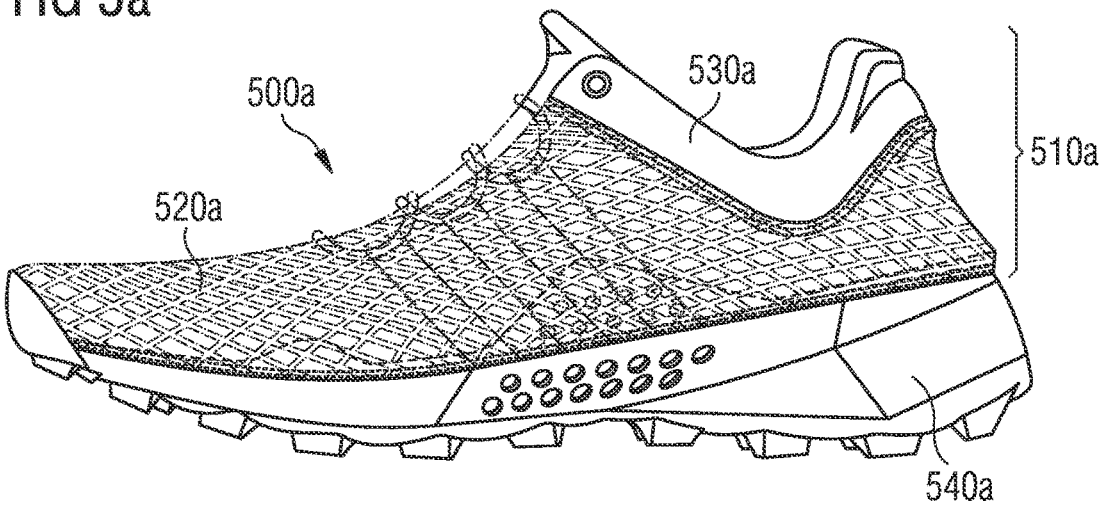
FIGS. 5*a*-5*b* are side views of a shoe with an ankle collar, according to certain embodiments of the present invention.
Figure 5B:
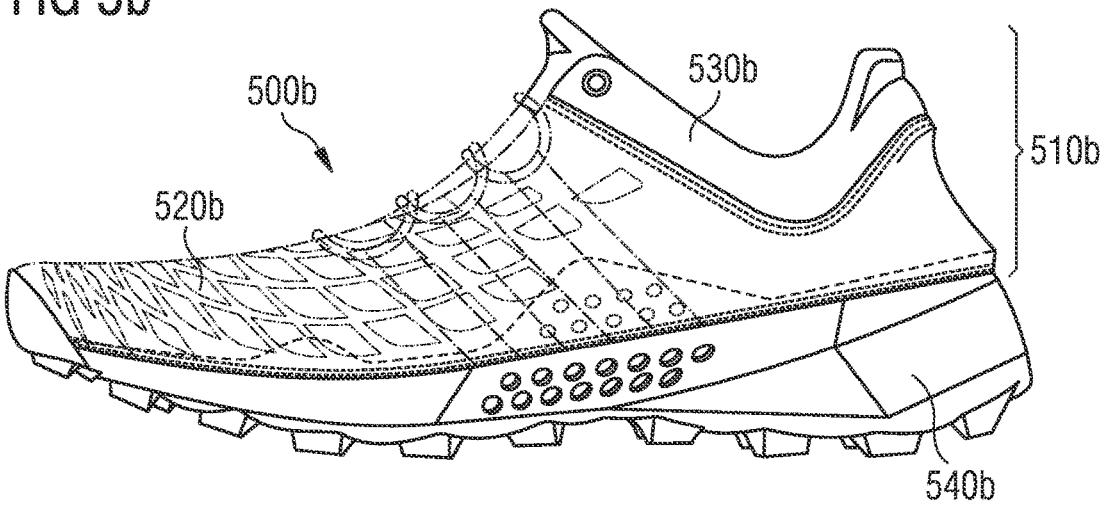

Finally, FIGS. 5*a-b* show two further embodiments of inventive shoes 500*a* and 500*b*.

Both shoes 500*a*, 500*b* comprise a respective upper 510*a*, 510*b* which comprises a textile region 520*a*, 520*b* in the forefoot and midfoot region. The upper 510*a*, 510*b* essentially, in the embodiments 500*a*, 500*b* shown here even exclusively, consists of textile material in the forefoot region and in parts of the midfoot region. Furthermore, the textile region 520*a*, 520*b* even extends into the heel region in the shoes 500*a*, 500*b* shown here, such that a particularly light-weight and well ventilated shoe 500*a*, 500*b* can be created. The textile region 520*a* is provided in a net- or lattice-shape throughout, whereas the textile region 520*b* comprises ventilation openings with different designs in the forefoot and midfoot region.

Both shoes further comprise shoe soles 540*a*, 540*b* which may, for example, comprise foamed EVA or randomly arranged particles of an expanded material like, for example, expanded thermoplastic polyurethane or expanded polyetherblockamide, which are fused at their surfaces.

Finally, the respective upper 510*a*, 510*b* comprises a one-piece ankle collar 530*a*, 530*b* made from a non-textile flexible plastic material, for example, EVA or PU, which extends below an ankle and around the heel from a lateral to a medial side of the upper 530*a*, 530*b*. In each case, a medial top edge of the ankle collar 530*a*, 530*b* comprises a different design than a lateral top edge of the ankle collar 530*a*, 530*b* in order to adapt to the different shape of the medial and lateral side of the ankle.

With regard to the inventive possibilities for the design of such an ankle collar, reference is made to the explanations further above, which explicitly apply at this point and are therefore not repeated again.

In the following, further examples are described to facilitate the understanding of the invention:

1. Shoe (100; 200), in particular sports shoe, with
   a. an upper (110; 210) comprising a textile region (120; 220) in the forefoot and/or midfoot region;
   b. a heel cap (130; 230) of the upper (110; 210) which encompasses a heel of a foot from behind and on a medial and lateral side;
   c. wherein solely the heel cap (130; 230) forms a heel region of the upper (110; 210); and
   d. wherein the heel cap (130; 230) is manufactured essentially as one piece from a non-textile flexible plastic material.
2. Shoe (100; 200) according to the preceding example, wherein the heel cap (130; 230) consists of ethylene-vinyl-acetate, EVA.
3. Shoe (100; 200) according to any one of the preceding examples, wherein the heel cap (130; 230) extends down to a sole (140; 240) of the shoe (100; 200) without forming a part of the sole (140; 240).
4. Shoe (100; 200) according to any one of the preceding examples, wherein the one-piece heel cap (130; 230) further comprises a medial side wing (150) and a lateral side wing (160; 260) which each extend up to a fastening region (170; 270) of the shoe (100; 200).
5. Shoe (100) according to the preceding example, wherein the medial (150) and the lateral side wing (160) each comprise a reinforcing element (155; 165) which serves to receive a fastening means, in particular a shoe lace (199).
6. Shoe (100) according to the preceding example, wherein the reinforcing element (155; 165) comprises a larger stiffness than the flexible plastic material of the heel cap (130) and comprises a socket for an eyelet (158; 168).
7. Shoe (200) according to any one of the preceding examples 4-6, wherein the medial side wing and the lateral side wing (260) are provided such that they enclose the foot on its top surface.
8. Shoe (100; 200) according to any one of the preceding examples, wherein the heel cap (130; 230) extends below an ankle and around the heel from the lateral to the medial side of the upper (110; 210) and wherein a medial top edge (131) of the heel cap (130; 230) comprises a different design than a lateral top edge (135) of the heel cap (130; 230) in order to adapt to the different shape of the medial and lateral side of the ankle
9. Shoe (100; 200; 500*a*; 500*b*), in particular sports shoe, with
   a. an upper (110; 210; 510*a*; 510*b*) comprising a textile region (120; 220; 520*a*; 520*b*) in the forefoot and/or midfoot region;
   b. a one-piece ankle collar (130; 230; 330; 430; 530*a*; 530*b*) of the upper (110; 210; 510*a*; 510*b*) made from a non-textile flexible plastic material, which extends below an ankle and around the heel from a lateral to a medial side of the upper (110; 210; 510*a*; 510*b*); wherein
   c. a medial top edge (131; 331) of the ankle collar (130; 230; 330; 430; 530*a*; 530*b*) comprises a different design than a lateral top edge (135; 335) of the ankle collar (130; 230; 330; 430; 530*a*; 530*b*) in order to adapt to the different shape of the medial and lateral side of the ankle.
10. Shoe (100; 200; 500*a*; 500*b*) according to example 9, wherein the ankle collar (130; 230; 330; 430; 530*a*; 530*b*) consists of ethylene-vinyl-acetate, EVA.
11. Shoe (100; 200; 500*a*; 500*b*) according to example 9, wherein the ankle collar (130; 230; 330; 430; 530*a*; 530*b*) consists of polyurethane, PU, and wherein the shoe (100; 200; 500*a*; 500*b*) further comprises a textile material which is arranged on an inside of the ankle collar (130; 230; 330; 430; 530*a*; 530*b*).
12. Shoe (100; 200; 500*a*; 500*b*) according to any one of the preceding examples 9-11, wherein the medial top edge (131; 331) of the ankle collar (130; 230; 330; 430; 530*a*; 530*b*) comprises a medial ankle depression (132; 332) and the lateral top edge (135; 335) of the ankle collar (130; 230; 330; 430; 530*a*; 530*b*) comprises a lateral ankle depression (136; 336) and wherein low points (133; 137; 333; 337) of the medial (132; 332) and lateral (136; 336) ankle depression are located at different positions along a longitudinal axis of the shoe (100; 200; 500*a*; 500*b*) and/or are located a different distance from a support surface for the foot.
13. Shoe (100; 500*a*; 500*b*) according to any one of the preceding examples 9-12, wherein the ankle collar (130; 330; 530*a*; 530*b*) comprises a medial (155) and a lateral (165) reinforcing element which each serve to receive a fastening means, in particular a shoe lace (199).
14. Shoe (100, 500*a*; 500*b*) according to the preceding example, wherein the medial (155) and the lateral (165) reinforcing element each comprise a larger stiffness than the flexible plastic material of the ankle collar (130; 330; 530*a*; 530*b*) and further each comprise a socket for an eyelet (158; 168).
15. Shoe (200) according to any one of the preceding examples 9-14, wherein the ankle collar (230; 430) enclose the foot of a wearer on its top side.
16. Shoe (100; 200) according to any one of the preceding examples 9-15, wherein the ankle collar (130; 230) encompasses the heel of a foot from behind and on the medial and lateral side and wherein solely the ankle collar (130; 230) forms a heel region of the upper (110; 210).

17. Shoe (100; 200; 500*a*; 500*b*) according to any one of the preceding examples, wherein the heel cap or the ankle collar (130; 230; 330; 430; 530*a*; 530*b*) comprises a widened support region at a top edge (131; 135; 331; 335).

18. Shoe (100; 200; 500*a*; 500*b*) according to the preceding example, wherein the widened support region comprises an outwardly curved region of the flexible plastic material of the heel cap or the ankle collar (130; 230; 330; 430; 530*a*; 530*b*).

19. Shoe (500*a*; 500*b*) according to any one of the preceding examples, wherein the upper (510*a*; 510*b*) essentially consists of one or more textile materials in the forefoot and/or midfoot region (520*a*; 520*b*).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A shoe comprises:

a forefoot region, a midfoot region, and a heel region;

a longitudinal axis aligned to have a rearward direction and a forward direction, the rearward direction oriented extending away from the forefoot region and toward the heel region, the forward direction oriented extending away from the heel region and toward the forefoot region, wherein rearmost refers to rearmost in the rearward direction and foremost refers to foremost in the forward direction;

a sole having an upper perimeter edge and formed of a first material;

an upper separate from the sole and coupled with the sole along the upper perimeter edge of the sole, the upper comprising at least an upper side panel and a heel cap, wherein the upper side panel is arranged to be at least one of adjacent or located in the forward direction of an arch of a wearer's foot when the shoe is worn by the wearer, the upper side panel comprising a textile fabric region in at least one of the forefoot region and the midfoot region, wherein the textile fabric region of the upper side panel is formed of a second material different from the first material;

a vertical axis aligned to have an upward direction and a downward direction, the upward direction oriented extending away from the sole and toward the upper, the downward direction oriented extending away from the upper and toward the sole, wherein topmost refers to topmost in the upward direction and lowermost refers to lowermost in the downward direction; and a means for connecting the heel cap of the upper to the upper side panel of the upper;

wherein the heel cap at least partially surrounds a rear side, a medial side, and a lateral side of a heel of the wearer's foot when worn;

wherein the heel cap forms the heel region of the upper;

wherein the heel cap has a lowermost edge that terminates at or above the upper perimeter edge of the sole; and wherein the heel cap is entirely formed of a third material different from the first material and the second material, and wherein the third material is a single piece of thermoplastic foam, the heel cap having a first surface and a second surface, wherein the first surface forms a portion of an exterior-most surface of the shoe, wherein the second surface forms a portion of an interior-most surface of the shoe facing a foot opening of the shoe for receiving a foot of the wearer, wherein the heel cap further comprises an upper rim edge around the foot opening, wherein a portion of the upper rim edge that is rearmost along the longitudinal axis defines a portion of the exterior-most surface of the shoe.

2. The shoe according to claim 1, wherein the thermoplastic foam of the third material of the heel cap is formed of ethylene- vinyl-acetate ("EVA").

3. The shoe according to claim 1, wherein the heel cap further comprises a medial side wing and a lateral side wing, wherein each wing extends up to a fastening region of the shoe.

4. The shoe according to claim 3, wherein the medial side wing and the lateral side wing each comprise a reinforcing element that is configured to receive a shoe lace.

5. The shoe according to claim 4, wherein the reinforcing element comprises a greater stiffness than the third material of the heel cap and comprises a socket for an eyelet.

6. The shoe according to claim 3, wherein the medial side wing and the lateral side wing each at least partially enclose a top surface of the foot of the wearer when worn.

7. The shoe according to claim 1, wherein the heel cap comprises a medial side and a lateral side, wherein a top edge of the medial side and a top edge of the lateral side are positioned below an ankle of the wearer when worn, wherein the top edge of the medial side of the heel cap comprises a different design than the top edge of the lateral side of the heel cap in order to adapt to a different shape of a medial side and a lateral side of the wearer's ankle.

8. The shoe according to claim 1, wherein the lowermost edge of the heel cap abuts the upper perimeter edge of the sole.

9. The shoe according to claim 1, wherein the upper further comprises a tongue region located at a different position than the textile fabric region of the upper.

10. The shoe according to claim 1, wherein the means for connecting comprises stitching along a juncture of the upper side panel with the heel cap.

11. The shoe according to claim 1, wherein the lowermost edge of the heel cap terminates at the upper perimeter edge of the sole.

12. A shoe comprises:

a forefoot region, a midfoot region, and a heel region;

a longitudinal axis aligned to have a rearward direction and a forward direction, the rearward direction oriented extending away from the forefoot region and toward the heel region, the forward direction oriented extending away from the heel region and toward the forefoot region, wherein rearmost refers to rearmost in the rearward direction and foremost refers to foremost in the forward direction;

a sole having an upper perimeter edge and formed of a first material;

an upper separate from the sole and coupled with the sole along the upper perimeter edge of the sole, the upper comprising at least an upper side panel and a one-piece ankle collar, wherein the upper side panel is arranged to be at least one of adjacent or located in the forward direction of an arch of a wearer when the shoe is worn by the wearer, the upper side panel comprising a textile fabric region in at least one of the forefoot region and the midfoot region, wherein the textile fabric region of the upper side panel is formed of a second material different from the first material;

a vertical axis aligned to have an upward direction and a downward direction, the upward direction oriented extending away from the sole and toward the upper, the downward direction oriented extending away from the upper and toward the sole, wherein topmost refers to topmost in the upward direction and lowermost refers to lowermost in the downward direction; and a means for connecting the one-piece ankle collar of the upper to the upper side panel of the upper;

wherein the one-piece ankle collar of the upper is entirely formed of a third material different from the first material and the second material, and wherein the third material is a single piece of thermoplastic foam, the one-piece ankle collar having a first surface and a second surface, the first surface forming a portion of an exterior-most surface of the shoe, the second surface forming a portion of an interior-most surface of the shoe facing a foot opening of the shoe for receiving a foot of a wearer, wherein the one-piece ankle collar further comprises an upper rim edge around the foot opening, wherein a portion of the upper rim edge that is rearmost along the longitudinal axis defines a portion of the exterior-most surface of the shoe, wherein the one-piece ankle collar has a lowermost edge that terminates at or above the upper perimeter edge of the sole.

13. The shoe according to claim 12, wherein the thermoplastic foam of the third material of the one-piece ankle collar is formed of ethylene-vinyl-acetate ("EVA").

14. The shoe according to claim 12, wherein the thermoplastic foam of the third material of the one-piece ankle collar is formed of polyurethane ("PU").

15. The shoe according to claim 12, wherein the one-piece ankle collar comprises a medial side and a lateral side, wherein a top edge of the medial side and a top edge of the lateral side are positioned below an ankle of the wearer when worn, wherein the top edge of the medial side of the one-piece ankle collar comprises a different design than the top edge of the lateral side of the one-piece ankle collar in order to adapt to a different shape of a medial side and a lateral side of the wearer's ankle, wherein the top edge of the medial side of the one-piece ankle collar comprises a medial ankle depression, and the top edge of the lateral side of the one-piece ankle collar comprises a lateral ankle depression, and wherein low points of the medial ankle depression and the lateral ankle depression are located according to at least one of (1) different positions along a longitudinal axis of the shoe and (2) a different distance from a support surface for the foot.

16. The shoe according to claim 12, wherein the one-piece ankle collar comprises a medial reinforcing element and a lateral reinforcing element, wherein each reinforcing element is configured to receive a shoe lace.

17. The shoe according to claim 16, wherein the medial reinforcing element and the lateral reinforcing element each comprise a greater stiffness than the third material of the one-piece ankle collar and further each comprise a socket for an eyelet.

18. The shoe according to claim 12, wherein the one-piece ankle collar at least partially encloses a top surface of the foot of the wearer when worn.

19. The shoe according to claim 12, wherein the one-piece ankle collar at least partially surrounds a rear side, a medial side, and a lateral side of a heel of the wearer's foot when worn, and wherein the one-piece ankle collar forms the heel region of the upper.

20. The shoe according to claim 12, wherein the upper consists essentially of one or more textile materials in at least one of the forefoot and the midfoot region.

21. The shoe according to claim 12, wherein the upper further comprises a tongue region located at a different position than the textile fabric region of the upper; wherein the means for connecting comprises stitching along a juncture of the upper side panel with the one-piece ankle collar; and wherein the lowermost edge of the one-piece ankle collar terminates at the upper perimeter edge of the sole.

* * * * *